US008556714B2

(12) United States Patent
Bowers et al.

(10) Patent No.: US 8,556,714 B2
(45) Date of Patent: Oct. 15, 2013

(54) PLAYER HEAD TRACKING FOR WAGERING GAME CONTROL

(75) Inventors: Travis L. Bowers, Chicago, IL (US); Mark B. Gagner, West Chicago, IL (US); Timothy T. Gronkowski, Chicago, IL (US); Damon E. Gura, Chicago, IL (US); Joel R. Jaffe, Glenview, IL (US); John F. LaSalvia, Las Vegas, NV (US); James E. Motyl, Chicago, IL (US); Victor T. Shi, Morton Grove, IL (US); Jorge L. Shimabukuro, Las Vegas, NV (US); Mark K. Trego, Chicago, IL (US); Michael C. Ward, Las Vegas, NV (US); Scott A. Massing, Lincolnwood, IL (US)

(73) Assignee: WMS Gaming, Inc., Wakegan, IL (US)

( * ) Notice: Subject to any disclaimer, the term of this patent is extended or adjusted under 35 U.S.C. 154(b) by 0 days.

(21) Appl. No.: 13/320,075

(22) PCT Filed: May 12, 2010
(Under 37 CFR 1.47)

(86) PCT No.: PCT/US2010/034551

§ 371 (c)(1),
(2), (4) Date: Apr. 25, 2012

(87) PCT Pub. No.: WO2010/132568

PCT Pub. Date: Nov. 18, 2010

(65) Prior Publication Data

US 2013/0023337 A1 Jan. 24, 2013

Related U.S. Application Data

(60) Provisional application No. 61/177,686, filed on May 13, 2009.

(51) Int. Cl.
*G07F 17/32* (2006.01)

(52) U.S. Cl.
USPC ..... 463/29; 463/16; 463/20; 463/25; 463/31

(58) Field of Classification Search
USPC ..... 463/16–20, 25–29, 36–38
See application file for complete search history.

(56) References Cited

U.S. PATENT DOCUMENTS 5,573,006 A 11/1996 Shimotani et al.
6,607,443 B1 8/2003 Miyamoto et al.

(Continued)

FOREIGN PATENT DOCUMENTS

WO WO2010132568 11/2010

OTHER PUBLICATIONS

"PCT Application No. PCT/US10/34551 International Preliminary Report on Patentability", Jun. 1, 2011 , 11 pages.

(Continued)

*Primary Examiner* — Omkar Deodhar
(74) *Attorney, Agent, or Firm* — DeLizio Gilliam, PLLC

(57) ABSTRACT

A wagering game system and its operations are described herein. In some embodiments, the operations can include presenting a wagering game on a display device of a wagering game machine. The operations can also include detecting head movements and facial gestures of a player of the wagering game via a video capture device of the wagering game machine, and generating player input data based on the head movements and facial gestures of the player. The operations can further include modifying wagering game content based on the player input data associated with the head movements and facial gestures of the player, and presenting results of the wagering game on the display device of the wagering game machine.

22 Claims, 9 Drawing Sheets

(56) References Cited

U.S. PATENT DOCUMENTS

| | | | | |
|---|---|---|---|---|
| 2006/0111171 | A1 | 5/2006 | Berg et al. | |
| 2006/0177109 | A1 | 8/2006 | Storch | |
| 2009/0143141 | A1 * | 6/2009 | Wells et al. | 463/37 |

OTHER PUBLICATIONS

"PCT Application No. PCT/US10/34551 International Search Report", Jul. 16, 2010 , 9 pages.

* cited by examiner

PLAYER HEAD TRACKING FOR WAGERING GAME CONTROL

RELATED APPLICATIONS

This application claims the priority benefit of U.S. Provisional Application Ser. No. 61/177,686 filed May 13, 2009.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2010, WMS Gaming, Inc.

FIELD

Embodiments of the inventive subject matter relate generally to wagering game systems, and more particularly to player head tracking for wagering game control in wagering game systems.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

SUMMARY

In some embodiments, a method comprises presenting a wagering game on a display device of a wagering game machine; detecting head movements and facial gestures of a player of the wagering game via a video capture device of the wagering game machine; generating player input data based on the head movements and facial gestures of the player; modifying wagering game content based on the player input data associated with the head movements and facial gestures of the player; and presenting results of the wagering game on the display device of the wagering game machine.

In some embodiments, the method further comprises detecting whether the player is in range of the video capture device of the wagering game machine.

In some embodiments, said detecting whether the player is in range of the video capture device comprises detecting whether the player's head is positioned within a predefined range from the video capture device.

In some embodiments, said detecting head movements and facial gestures of the player comprises capturing video of the head movements and facial gestures of the player via the video capture device.

In some embodiments, said generating player input data comprises, based on the video of the player's head movements and facial gestures, generating Cartesian coordinate data for a plurality of data points associated with the player's head and facial features at various instances in time.

In some embodiments, said modifying wagering game content comprises modifying an orientation of wagering game content being presented on the display device of the wagering game machine based on the player input data associated with the player's head movements and facial gestures.

In some embodiments, the method further comprises initiating a wagering game session at the wagering game machine in response to detecting a swipe of a player card in a card reader of the wagering game machine; detecting, via the video capture device, that the player is in range of the wagering game machine prior to presenting the wagering game on the display device of the wagering game machine; and terminating the wagering game session in response to detecting, via the video capture device, that the player is no longer in range of the wagering game machine.

In some embodiments, the method further comprises detecting a position of the player relative to the wagering game machine via the video capture device, and adjusting at least one of a height of a gaming chair of the wagering game machine and a position of a display of the wagering game machine based on the position of the player.

In some embodiments, the video capture device is a video camera.

In some embodiments, a wagering game machine comprises a gaming chair comprising a plurality of light emitting diodes (LEDs); a wagering game terminal coupled to the gaming chair, the wagering game terminal comprises a presentation unit configured to present a wagering game and wagering game results on a display device of the wagering game terminal; an LED light detector configured to detect head movements of a player of the wagering game based on light emitted from the plurality of LEDs; and a wagering game unit configured to generate player input data based on the player's head movements detected by the LED light detector, wherein the wagering game unit is further configured to modify content of the wagering game based on the player input data associated with the player's head movements.

In some embodiments, the plurality of LEDs are positioned on a headrest of the gaming chair.

In some embodiments, the LED light detector is configured to detect the player's head movements by detecting which of the plurality of LEDs are and are not blocked by the player's head.

In some embodiments, the wagering game unit is configured to generate player input data indicating which of the plurality of LEDs are and are not blocked by the player's head.

In some embodiments, the wagering game unit is configured to modify an orientation of the wagering game content being presented on the display device of the wagering game terminal based on the player input data associated with the player's head movements.

In some embodiments, the gaming chair further comprising a plurality of weight sensors configured to detect leaning movements of the player to modify content of the wagering game.

In some embodiments, a wagering game machine comprises means for presenting a wagering game on a display device of the wagering game machine; means for capturing video of head movements and facial gestures of a player of the wagering game; means for generating player input data based on the video of the head movements and facial gestures of the player; means for modifying content of the wagering game based on the player input data associated with the video of the head movements and facial gestures of the player; and means for presenting results of the wagering game on the display device of the wagering game machine.

In some embodiments, the wagering game machine further comprises means for detecting whether the player is in range of the wagering game machine.

In some embodiments, said means for detecting whether the player is in range of the wagering game machine comprises means for detecting whether the player's head is positioned within a predefined range from the wagering game machine.

In some embodiments, said means for generating player input data comprises means for generating, based on the video of the player's head movements and facial gestures, Cartesian coordinate data for a plurality of data points associated with the player's head and facial features at various instances in time.

In some embodiments, said means for modifying wagering game content comprises means for modifying an orientation of wagering game content being presented on the display device of the wagering game based on the player input data associated with the player's head movements and facial gestures.

In some embodiments, a method comprises determining a plurality of multiplayer wagering games that are available for play at a plurality of wagering game machines based on a number of players detected at the wagering game machines; causing each of the wagering game machines to present a visual indication of the multiplayer wagering games that are available for play; initiating, based on player selection, one of the multiplayer wagering games for presentation on each of the wagering game machines; receiving player input data from the plurality of wagering game machines, wherein the player input data is generated based on head movements and facial gestures of each of the players detected at each of the wagering game machines via a video capture device; modifying content of the multiplayer wagering game being presented on the plurality of wagering game machines based on the player input data associated with the head movements and facial gestures of the players; and generating results associated with the multiplayer wagering game.

In some embodiments, the method further comprises receiving an indication, from each of the wagering game machines, when each of the players is in range of the video capture device of a corresponding wagering game machine.

In some embodiments, said causing each of the wagering game machines to present a visual indication of the multiplayer wagering games that are available for play comprises sending a message to each of the wagering game machines indicating the multiplayer wagering games that are available for play to cause the wagering game machines to present a visual indication of the multiplayer wagering games that are available for play.

In some embodiments, the method further comprises detecting when a player completes a wagering game session on a wagering game machine of the plurality of wagering game machines, detecting when the player moves away from the wagering game machine and moves past each of the plurality of wagering game machines, and presenting customized game content to the player as the player moves past each of the plurality of wagering game machines.

In some embodiments, one or more machine-readable media, having instructions stored therein, which, when executed by a set of one or more processors causes the set of one or more processors to perform operations that comprise: presenting a wagering game on a display device of a wagering game machine; detecting body movements of a player of the wagering game via a movable gaming chair of the wagering game machine; generating player input data based on the body movements of the player; modifying wagering game content based on the player input data associated with the player's body movements; and presenting results of the wagering game on the display device of the wagering game machine.

In some embodiments, the operations further comprise detecting whether the player is seated on the movable gaming chair of the wagering game machine via a weight sensor.

In some embodiments, said operation of generating player input data based on the player's body movements comprises generating Cartesian coordinate data for the player's body movements at various instances in time.

In some embodiments, said operation of modifying wagering game content based on the player input data comprises modifying an orientation of wagering game content being presented on the display device of the wagering game machine based on the player input data associated with the player's body movements.

BRIEF DESCRIPTION OF THE FIGURES

Embodiments are illustrated in the Figures of the accompanying drawings in which.

DESCRIPTION OF THE EMBODIMENTS

This description of the embodiments is divided into six sections. The first section provides an introduction to some embodiments, while the second section describes example wagering game machine architectures. The third section describes example operations performed by some embodiments and the fourth section describes example wagering game machines in more detail. The fifth section describes additional embodiments, and the sixth section presents some general comments.

Introduction

This section provides an introduction to some embodiments.

Wagering game systems offer wagering game players ("players") entertainment value and the opportunity to win monetary value. In some embodiments, wagering game systems can attempt to enhance the gaming experience by allowing players to modify wagering game content, and play the wagering game, based on the player's head movements, facial gestures, and/or body movements. In one example, wagering game machines may include a camera, or other video capture device, for detecting head movements and facial gestures of the player. In another example, wagering game machines can include a chair mounted on a platform connected to a wagering game terminal. In this example, the chair may include a row or matrix of light-emitting diodes (LEDs) mounted on the headrest of the chair, and the wagering game terminal may include an LED light detector for detecting head movements of the player. In yet another example, wagering game machines may include a movable gaming chair that can be used as a joystick, i.e., the chair can be designed to rotate 360 degrees and tilt in all directions to detect body movements of the player.

Figure 1A:
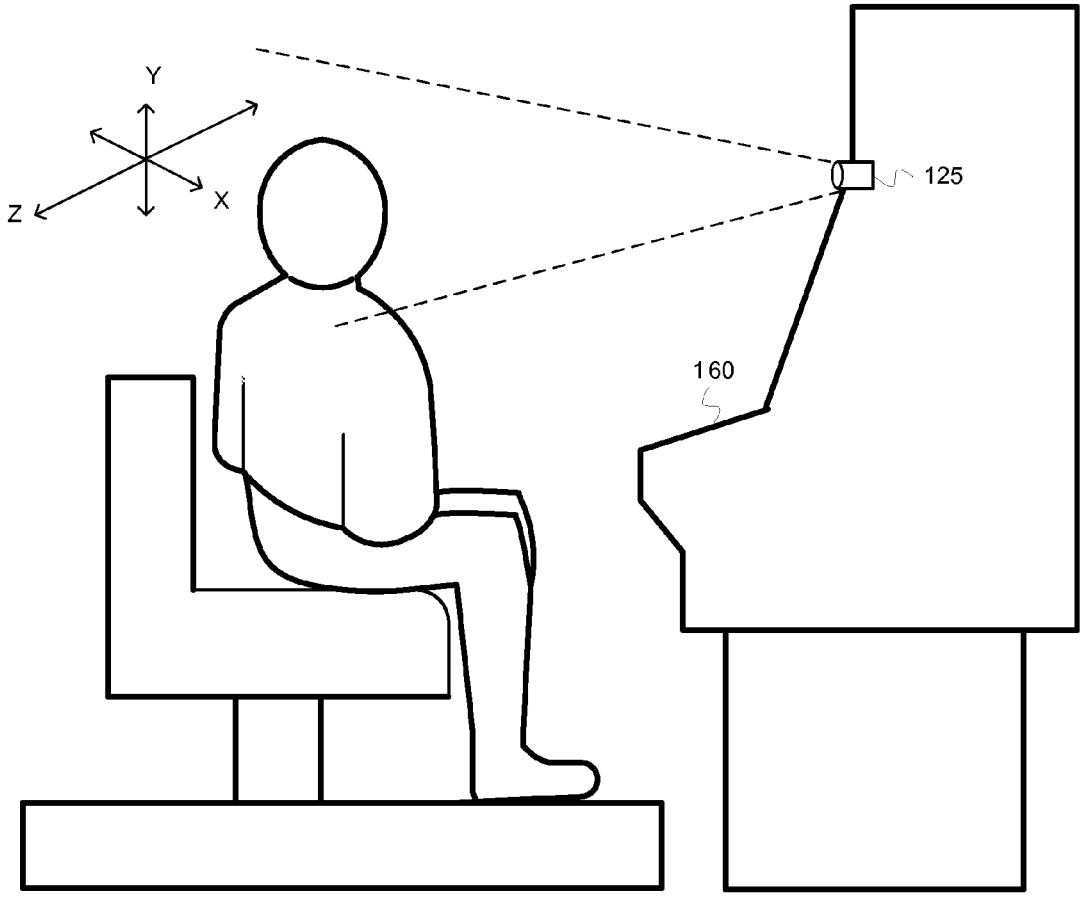
FIG. 1A is a conceptual diagram illustrating a wagering game machine comprising a video capture device, according to some embodiments.

FIG. 1A is a conceptual diagram illustrating a wagering game machine 160 comprising a video capture device 125, according to some embodiments. The video capture device 125 can be a camera, e.g., a webcam or similar device, configured to detect head movements, facial gestures, and facial features of a player of a wagering game that is being presented on the wagering game machine 160. The wagering game machine 160 implements facial recognition techniques to identify the player of the wagering game based on the facial features detected by the video capture device 125. Furthermore, the wagering game machine 160 generates player input data based on the head movements and facial gestures of the player detected by the video capture device 125. The wagering game machine 160 then modifies the content of the wagering game based on the player input data associated with the head movements and facial gestures of the player. For example, the wagering game machine 260 can modify one or more game elements of the wagering game and/or modify the orientation of the game content to provide the player a different point of view with respect to the game content. It is noted, however, that in other embodiments the video capture device 125 may also be configured to detect and process hand gestures, or movements of other body parts, as player input to modify the content of the wagering game. In various embodiments, the wagering game machine 160 may include visible and/or nonvisible light sources, which can be used by the video capture device 125 to illuminate the player in order to enhance detection.

Figure 1B:
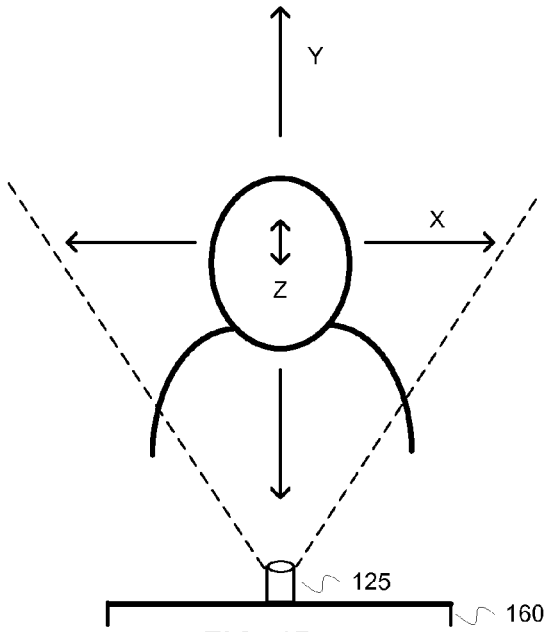
FIG. 1B is a conceptual diagram illustrating how the wagering game machine of FIG. 1A tracks the player's head movements, according to some embodiments.

In some implementations, the video capture device 125 can capture video of the player's head movements, facial gestures, and facial features. The wagering game machine 160 can then generate player input data (e.g., a plurality of variables) that represents the x, y, and z coordinates of the player's head at various instances in time. This data can be use to determine the player's head movements. The wagering game machine 160 can also generate player input data that represents the x, y, and z coordinates of various data points of the player's facial features. This data can be used to determine the player's facial movements, i.e., the player's facial gestures. In one example, the wagering game machine 160 may generate player input data that represents the x, y, and z coordinates for multiple data points in a player's eyes, nose, mouth, forehead, chin, etc. The wagering game machine 160 can process the player input data associated with the head movements and facial gestures of the player to determine how to modify the content of the wagering game. In one example, the wagering game machine 160 can compare the x, y, and z coordinates of the player's head at various instance in time to one or more reference points, e.g., (x,y,z)=(0,0,0), to quantify the player's head movement with respect to the one or more reference points. In this example, the wagering game machine 160 can modify the content of the wagering game in response to detecting changes from the one or more reference points. FIG. 1B is a conceptual diagram illustrating how the wagering game machine 160 including the video capture device 125 tracks the player's head movements based on an x,y,z axis, according to some embodiments. It is noted, however, that in other implementations the wagering game machine 160 can generate different player input data (e.g., only x,y coordinates or only data associated with head movements) and perform other operations to determine how to modify the content of the wagering game.

In some examples, the head movements and facial gestures of a player can be used to maneuver a car, plane, boat, avatar, submarine, or other game content of a wagering game, e.g., a bonus game. In one example, when a player moves his head to the left or right, the car turns left or right, respectively. When the player moves his head forward, the car accelerates, and when the player moves his head backward, the car decelerates. If the player smiles, turbo boosters can be triggered and the car accelerates at double the normal speed. In other examples, the head movements of the player can change the orientation of the game content to give the impression that the player is viewing the game content from a different perspective or point of view. In other words, by modifying the orientation of the game content, the point of view of the player is changed with respect to the game content. For example, when a player is presented with an obstacle within a game (e.g., a picking bonus game), if a player moves his head up, the orientation of the game content is changed such that it gives the impression that the player is looking over (or behind) the obstacle. If the player moves his head left or right, the orientation of the game content also changes to give the impression that the player is looking around the obstacle. It is noted that the player's head and/or facial movements can be used to control various other types of wagering games, as will be further described below.

Figure 2A:
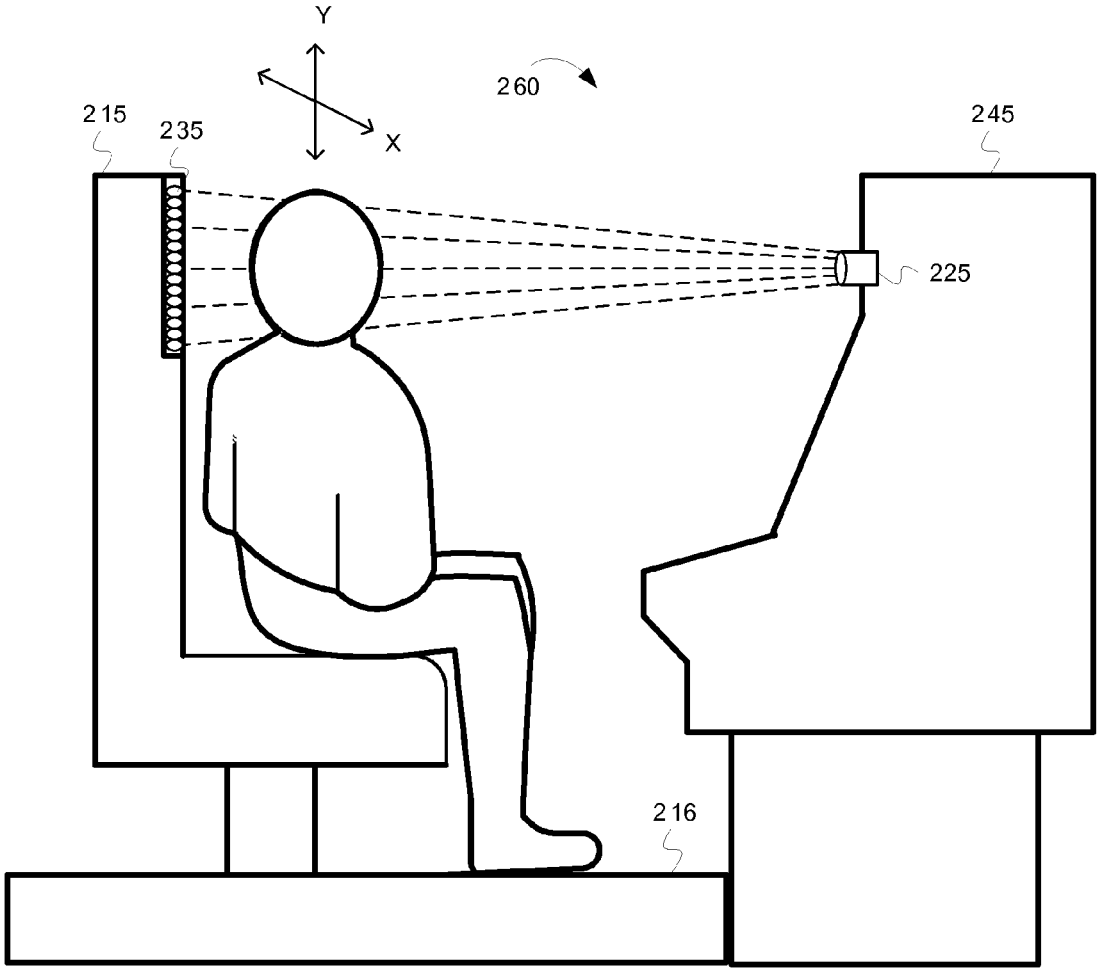
FIG. 2A is a conceptual diagram illustrating a wagering game machine comprising an LED light detector and LED lights, according to some embodiments.
Figure 2B:
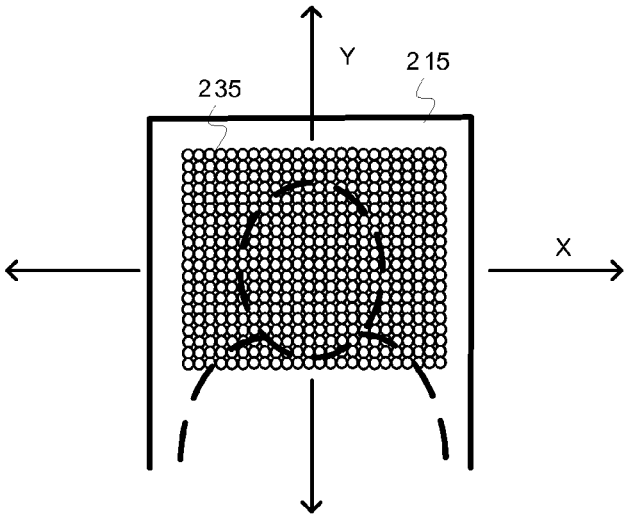
FIG. 2B is a conceptual diagram illustrating how the wagering game machine of FIG. 2A can detect LED lights in order to track the player's head movements, according to some embodiments.

FIG. 2A is a conceptual diagram illustrating a wagering game machine 260 comprising an LED light detector 225 and LEDs 235, according to some embodiments. In one implementation, the wagering game machine 260 includes a wagering game terminal 245 connected to a chair 215 via a platform 216. The chair 215 may include a row or matrix of LEDs 235 mounted on the headrest of the chair 215 (or in another location behind the player). In one example, the LEDs 235 may be infrared (IR) LEDs, and the LED light detector 225 may be an IR detector. The wagering game terminal 245 may include an LED light detector 225. The LED light detector 225 can detect head movements of the player by determining which of the LEDs 235 are blocked by the player's head and which LEDs 235 are not blocked by the player's head. The wagering game terminal 245 can generate player input data based on the head movements detected by the LED light detector 225. For example, the wagering game terminal 245 can generate data, such as x,y coordinates, based on which LEDs 235 are and are not blocked by the player's head. The wagering game terminal 245 can then modify the content of the wagering game based on the player input data associated with the player's head movements. FIG. 2B is a conceptual diagram illustrating how the wagering game machine 260 including the LED light detector 225 can detect which of the LEDs 235 are blocked by a player's head in order to track the player's head movements based on an x,y axis, according to some embodiments.

Figure 3A:
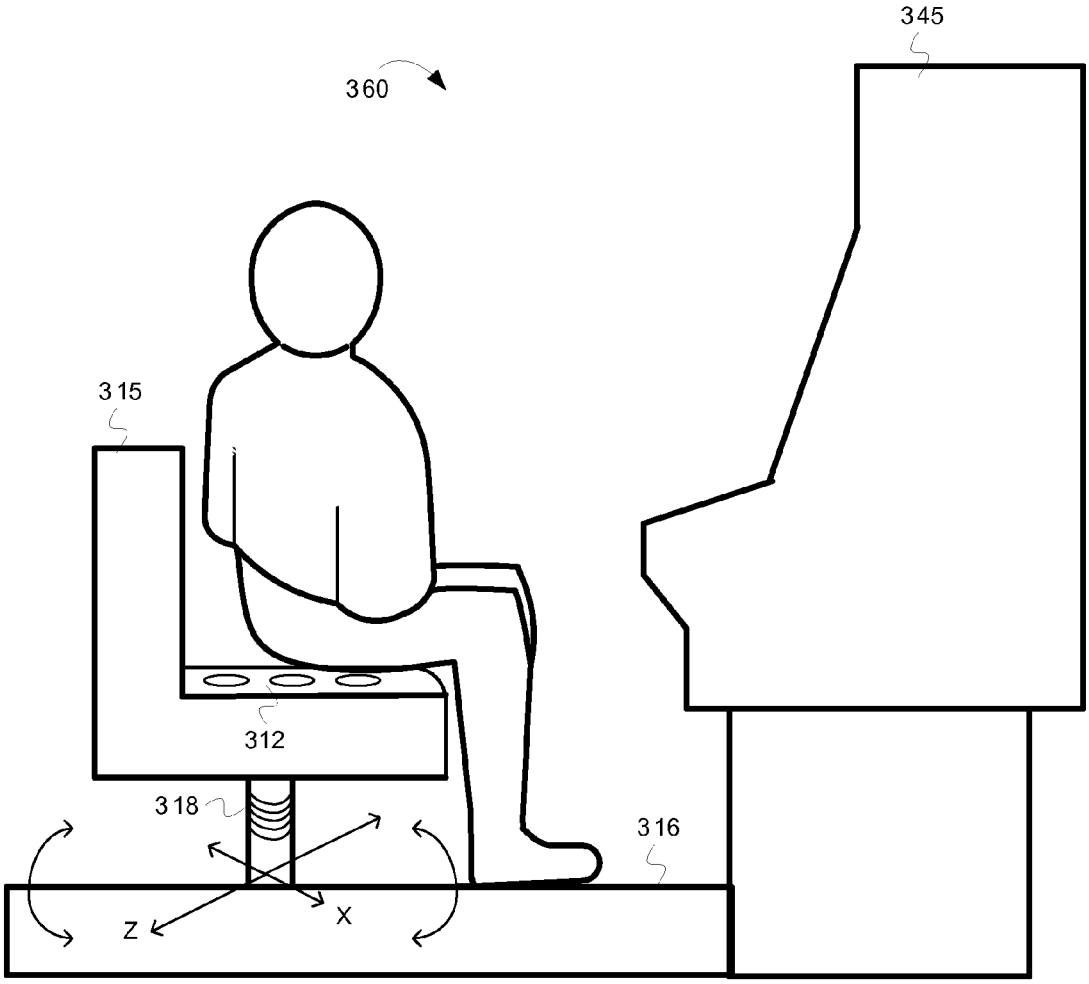
FIG. 3A is a conceptual diagram illustrating a wagering game machine including a movable gaming chair configured as an input device, according to some embodiments.
Figure 3B:
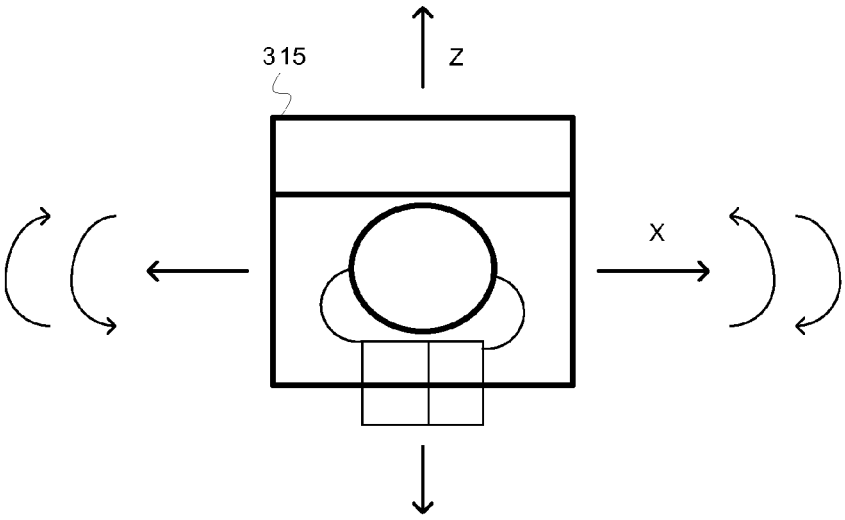
FIG. 3B is a conceptual diagram illustrating how the movable gaming chair of FIG. 3A can be used as an input device for detecting a player's body movements, according to some embodiments.

FIG. 3A is a conceptual diagram illustrating a wagering game machine 360 including a movable gaming chair 315 configured as an input device, according to some embodiments. As illustrated, the wagering game machine 360 includes a wagering game terminal 345 connected to a movable gaming chair 315 via a platform 316. In one example, the chair 315 can be designed to rotate 360 degrees and tilt in all directions via a movable stem 318 in order to operate as an input device. In another example, the chair 315 can be designed to have limited motion via the movable stem 318, e.g., only movable to the left, right, forward, and backward. The chair 315 with movable stem 318 can detect the player's body movements and generate player input data based on the detected body movements. In one example, the chair 315 can generate data, such as x,z coordinates, corresponding to the player's body movements and provide this data to the wagering game terminal 345. The wagering game terminal 345 can then modify the content of the wagering game based on the player input data associated with the player's body movements. FIG. 3B is a conceptual diagram illustrating how the chair 315 with movable stem 318 can be used as an input device for detecting a player's body movements on an x,z axis, according to some embodiments.

It is noted, however, that in other embodiments, wagering game machines may detect a player's body, head, and/or facial movements by other methods. In various embodiments, one or more of the components described above with reference to FIG. 1A-3B may be omitted, combined, modified, or additional components included, as desired. In one embodiment, the wagering game machine may include a wearable infrared (IR) emitter and an IR detector. In this embodiment, the player may wear the IR emitter around his head while he plays a wagering game. The IR detector can detect the player's head movements in order to modify content associated with the wagering game.

In some embodiments, wagering game machines may include other sensory devices, instead of or in addition to the video capture device 125, to detect the player's head movements and for depth perception. For example, wagering game machines can include magnetic sensors, inductive or RF field sensors, ultrasonic proximity sensors, etc. In other embodiments, in addition to or instead of having a gaming chair with a movable stem (or the video capture device 125) that can detect tilting or leaning movements of a player, wagering game machines can include a gaming chair with sensors on the seat and/or chair arms (e.g., weight sensors) to detect tilting or leaning movements of a player (e.g., sensors 312 in FIG. 3A). In one example, the chair sensors 312 can detect a player leaning from one side to the other and modify the game content based on the player's movements. It is further noted, that in some embodiments, some of the sensory devices described above may also be used for distance and/or eye-level detection, in order to automatically adjust certain settings of the wagering game machine based on the player's position, size, height, etc. For example, distance and/or eye level detection can be used to adjust the gaming chair height, move the gaming chair forward or backward, move the display and button panel of the wagering game machine, and/or adjust other parts and devices associated with the wagering game machine.

Although FIGS. 1-3 describes some embodiments, the following sections describe many other features and embodiments.

Operating Environment

This section describes example operating environments and networks and presents structural aspects of some embodiments. More specifically, this section includes discussion about wagering game system architectures.

Wagering Game System Architecture

Figure 4:
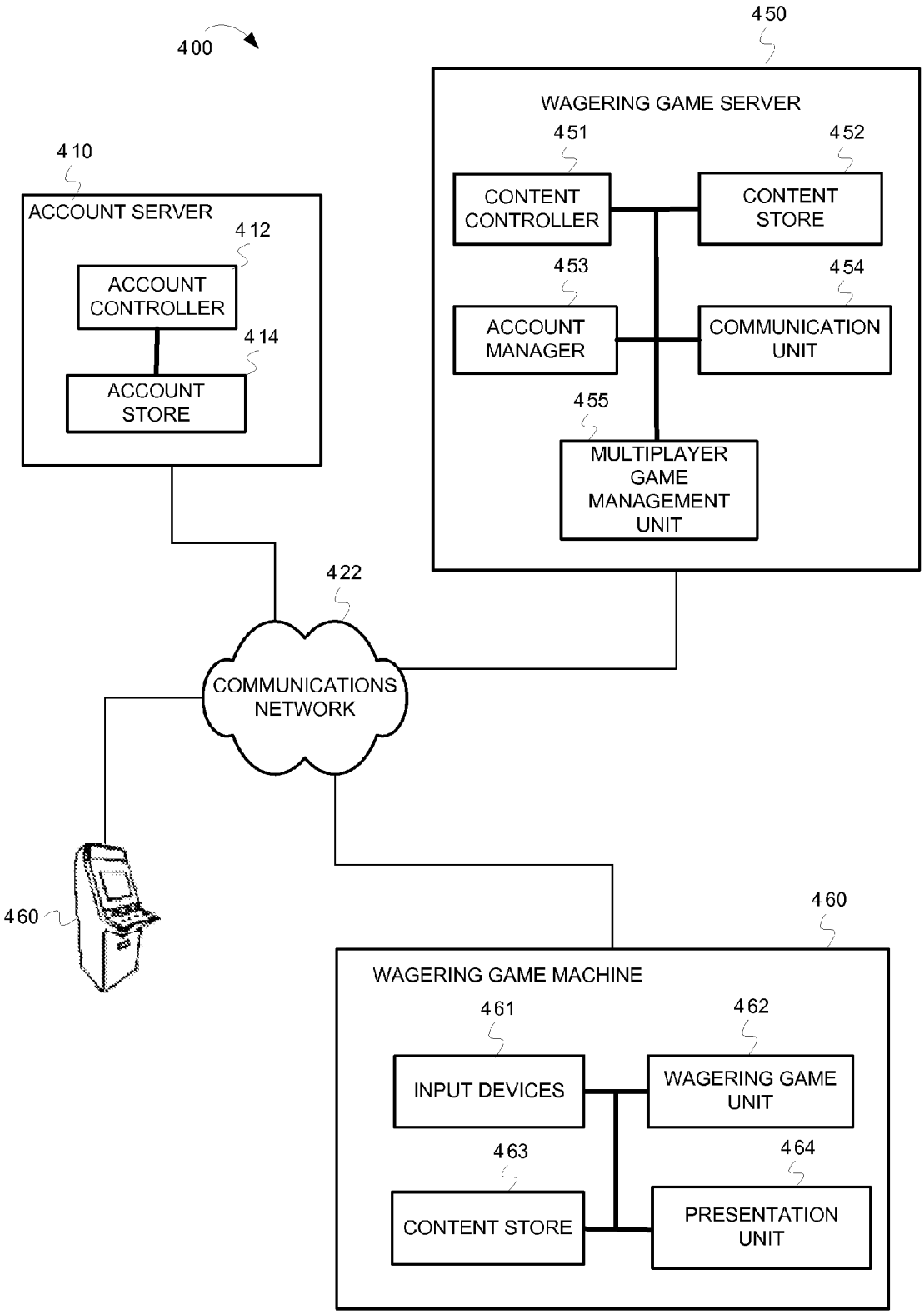
FIG. 4 is a conceptual diagram that illustrates an example of a wagering game system architecture, according to some embodiments.

FIG. 4 is a conceptual diagram that illustrates an example of a wagering game system architecture 400, according to some embodiments. As illustrated, the wagering game system architecture 400 includes an account server 410, a wagering game server 450, and a plurality of wagering game machines 460 coupled to a communication network 422. It is noted that the wagering game machines 460 may be representative of any of the wagering game machines shown in FIGS. 1A-3B.

The account server 410 is configured to control player related accounts accessible via wagering game networks and social networks. The account server 410 can store and track player information, such as identifying information (e.g., avatars, screen name, player profiles, account identification numbers, etc.) or other information like financial account information, social contact information, etc. The account server 410 can also provide auditing capabilities, according to regulatory rules, and track the performance of players, machines, and servers. The account server 410 can include an account controller 412 configured to control information for a player's account. The account server 410 can also include an account store 414 configured to store information for a player's account.

The wagering game system architecture 400 includes a wagering game server 450 configured to control wagering game content and communicate wagering game information, account information, and other information to and from a wagering game machine 460. The wagering game server 450 can include a content controller 451 configured to manage and control content for presentation on the wagering game machine 460. For example, using on a random number generator, the content controller 451 can generate game results (e.g., win/loss values), including win amounts, for games played on the wagering game machine 460 (e.g., slots, poker, roulette, etc.). The content controller 451 can communicate the game results to the wagering game machine 460. The content controller 451 can also generate random numbers and provide them to the wagering game machine 460 so that the wagering game machine 460 can generate game results. Furthermore, in some implementations, the content controller 451 can receive player input data from the wagering game machine 460 and control the game content that is presented on the wagering game machine 460 based on the received player input data. The content controller 451 may also present other types of content, such as advertising, player messages, hotel and casino information, etc. The wagering game server 450 can also include a content store 452 configured to store content used for presenting wagering games and other information on the wagering game machine 460.

The wagering game server 450 may also include an account manager 453 configured to control information related to player accounts. For example, the account manager 453 can communicate wager amounts, game results amounts (e.g., win amounts), bonus game amounts, etc., to the account server 410. The wagering game server 450 can also include a communication unit 454 configured to communicate information to the wagering game machine 460 and to communicate with other systems, devices and networks. Furthermore, the wagering game server 450 may include a multiplayer game management unit 455 configured to detect player input data received from a plurality of related wagering game machine 460 that offer players the opportunity to play multiplayer wagering games. The multiplayer game management unit 455 may control the presentation of content associated with multiplayer wagering games based on the player input data received from the plurality of related wagering game machines 460.

The wagering game system architecture 400 includes a plurality of wagering game machines 460 configured to present wagering games and receive and transmit information to control the content that is presented for the wagering games. The wagering game machine 460 can include input devices 461 configured to detect player input. For example, the input devices 461 can be buttons, joysticks, touch screens, cameras (e.g., see FIG. 1A), LED light detector (e.g., see FIG. 2A), movable gaming chairs (e.g., see FIG. 3A), etc. The wagering game machine 460 can include a wagering game unit 462 configured to manage and control the game content that is presented on the wagering game machine 460. The wagering game unit 462 can generate player input data based on player input detected by the input devices 461. For example, the wagering game unit 462 can generate player input data based on a player's head movements and facial gestures detected by a camera. The wagering game unit 462 can then modify the game content that is presented on the wagering game machine 460 based on the player input data. The wagering game unit 462 can also generate game results based on random numbers received from the wagering game server 450, or may communicate with the wagering game server 450 to obtain the game results. Additionally, the wagering game machine 460 can include a content store 463 configured to store content that is presented on the wagering game machine 460. The wagering game machine 460 may further include a presentation unit 464 configured to control the presentation of the game content on the wagering game machine 460. The presentation unit 464 can include one or more browsers and any other software and/or hardware suitable for presenting audio and video content. It is noted, however, that in other implementations the game content can be presented using other display technologies. Although FIG. 4 shows two wagering game machines 460, the wagering game system architecture 400 can include any number of wagering game machines (e.g., banks of stationary wagering game machines in one or more casinos).

Each component shown in the wagering game system architecture 400 is shown as a separate and distinct element connected via the communications network 422. However, some functions performed by one component could be performed by other components. For example, the wagering game server 450 can also be configured to perform functions of the account server 410. Furthermore, the components shown may all be contained in one device, but some, or all, may be included in, or performed by multiple devices, as in the configurations shown in FIG. 4 or other configurations not shown. Furthermore, the wagering game system architecture 400 can be implemented as software, hardware, any combination thereof, or other forms of embodiments not listed. For example, any of the network components (e.g., the wagering game machines, servers, etc.) can include hardware and machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Although FIG. 4 describes some embodiments, the following sections describe many other features and embodiments.

Example Operations

This section describes operations associated with some embodiments. In the discussion below, the flow diagrams will be described with reference to the block diagrams presented above. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform less than all the operations shown in any flow diagram.

Figure 5:
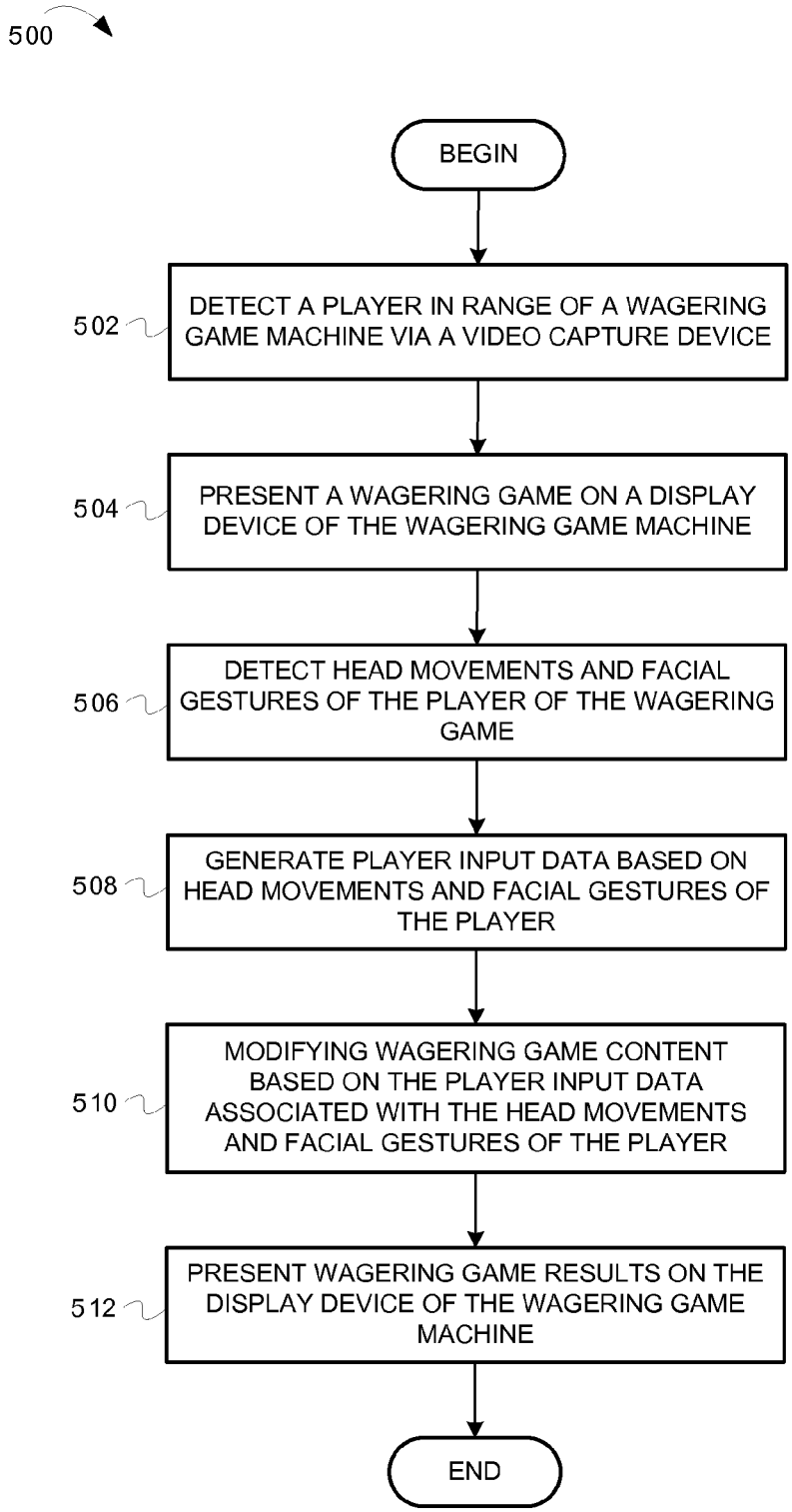
FIG. 5 is a flow diagram illustrating operations for modifying content associated with wagering games based on a player's head and facial movements, according to some embodiments.
Figure 6:
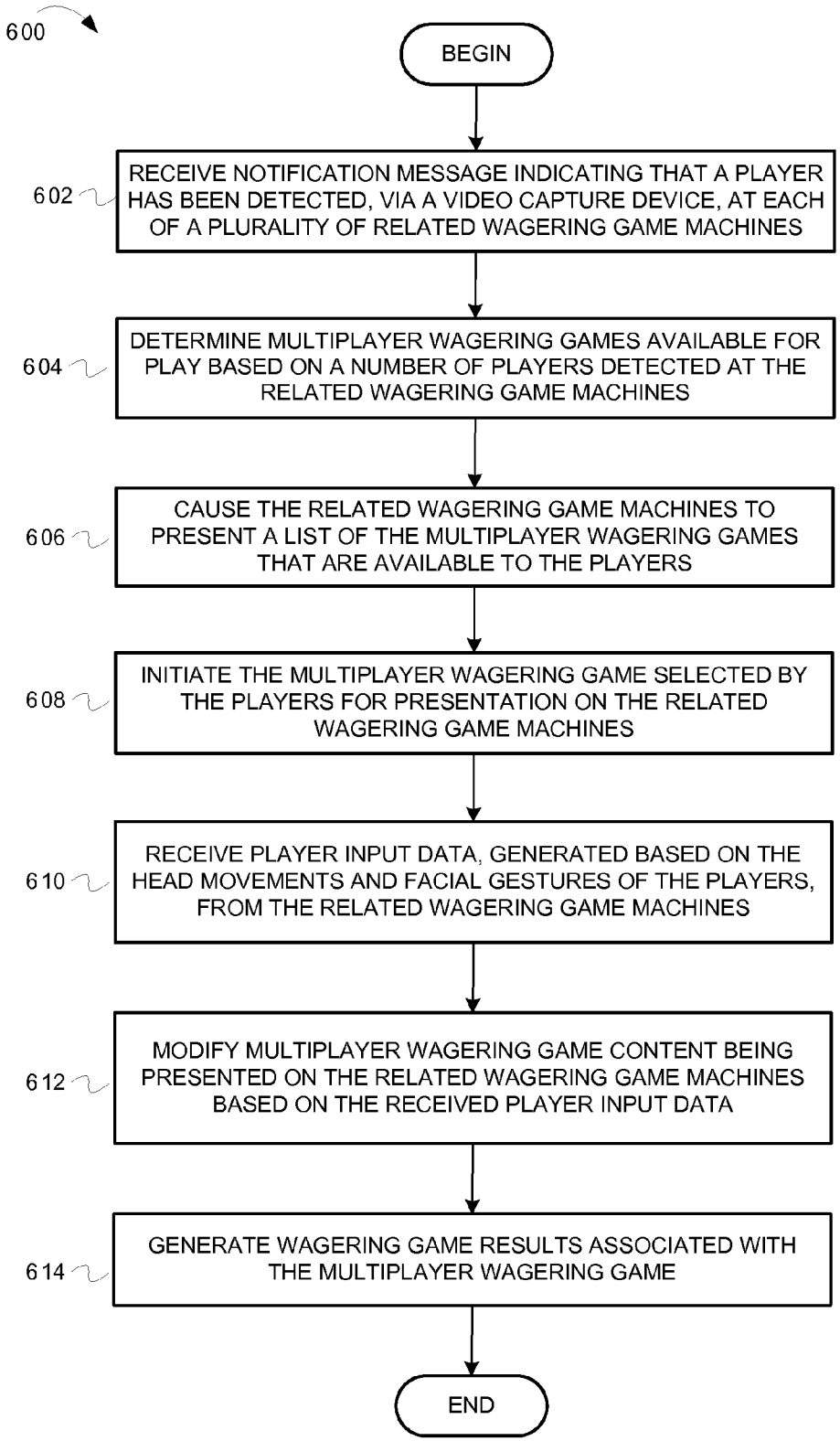
FIG. 6 is a flow diagram illustrating operations for modifying content associated with multiplayer wagering games based on players' head and facial movements, according to some embodiments.
Figure 7:
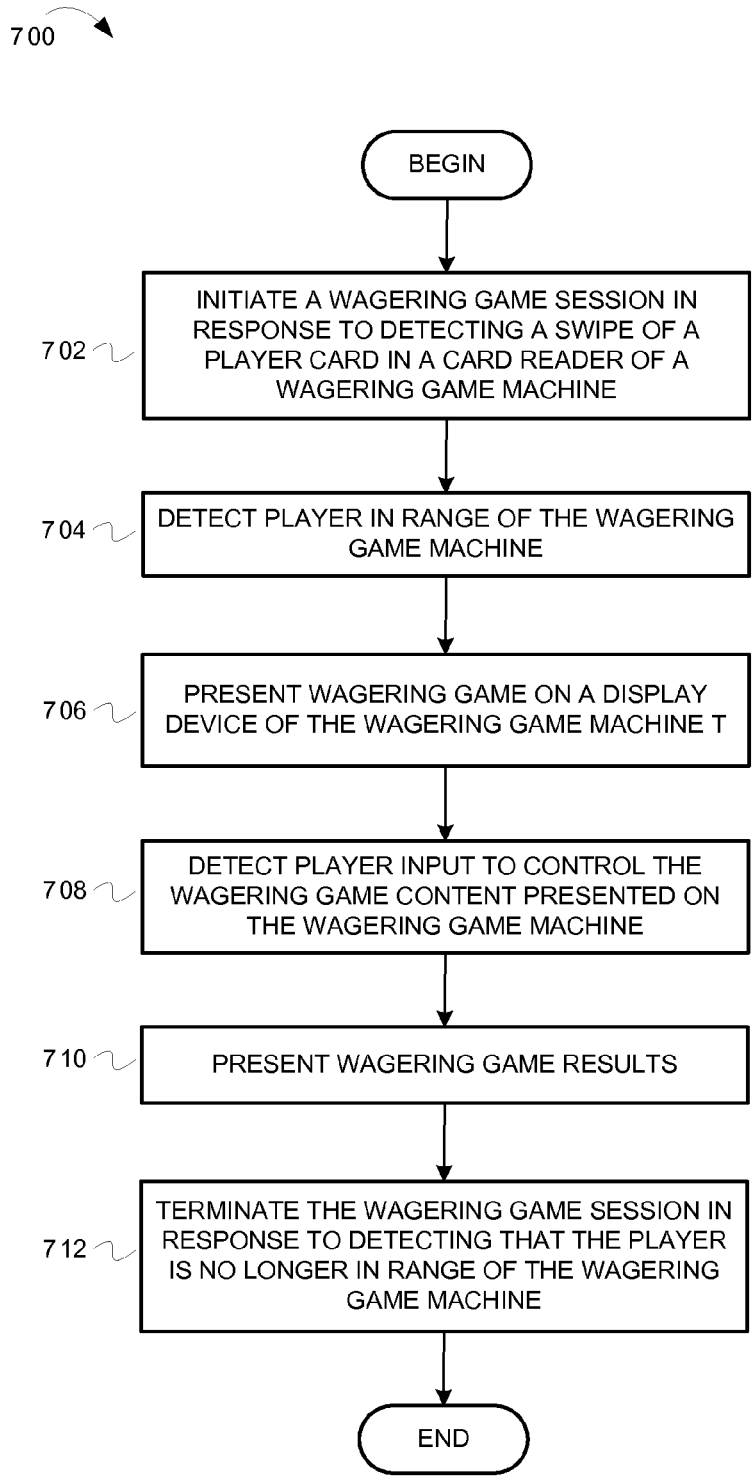
FIG. 7 is a flow diagram illustrating operations for initiating and/or terminating wagering game sessions based on head tracking and/or facial recognition for a player of a wagering game, according to some embodiments.

The following discussion of FIGS. 5 and 6 describes example mechanisms for modifying content associated with wagering games based on a player's head and/or facial movements. FIG. 7 describes an example mechanism for initiating and/or terminating wagering game sessions based on head tracking and/or facial recognition of a player.

FIG. 5 is a flow diagram ("flow") 500 illustrating operations for modifying content associated with wagering games based on a player's head and facial movements, according to some embodiments. The flow of 500 will be described with reference to the example wagering game machines of FIGS. 1A-3B and the example system architecture of FIG. 4. The flow diagram begins at block 502.

At block 502, an input device 461 of a wagering game machine 460 detects that a player is in range of the wagering game machine 460. In some implementations, a video capture device 125 (e.g., a webcam) of the wagering game machine 460 detects that a player's head is in range of the wagering game machine 460, e.g., as shown in FIGS. 1A and 1B. In one example, the video capture device 125 detects that a player's head is within a predefined range of x,y,z coordinates from the wagering game machine 460. In another example, the video capture device 125 detects that a player's head is within a predefined range of x,y coordinates from the wagering game machine 460. The video capture device 125 can filter out everything that is outside of the predefined range. In one example, the wagering game machine 460 may display a notification message, or other visual indication, indicating that the player is in range of the wagering game machine 460. If the player's head is not in range, then the wagering game machine 460 may display a notification message indicating that the player is outside the range of the video capture device 125. In one example, the wagering game machine 460 may display a visual indication (or output audio) instructing the player to move forward, backward, left, right, sit down, etc., in order to be positioned within the predefined range. In another example, the wagering game machine 460 may automatically move the gaming chair forward or backward, or adjust the chair height. It is noted, however, that in other implementations, depending on the position of the player's head, the wagering game machine 460 may automatically adjust other parts, e.g., the display, a button panel, and/or sensory devices associated with the wagering game machine 460 up or down, forward or backward, etc. It is further noted that these setting associated with the wagering game machine 460 can also be automatically adjusted based on the player's body position, size, height, the player's movements, etc. After block 502, the flow continues at block 504.

At block 504, the wagering game machine 460 presents a wagering game on a display device of the wagering game machine 460. For example, the presentation unit 464 presents a wagering game that can be controlled based on the player's head and/or facial movements. It is noted, however, that the wagering game may also be controlled using other available input devices, e.g., joysticks, buttons, touch screens, etc., or a combination of input devices. The presentation unit 464 may present the wagering game on a display device (e.g., LCD or plasma screen) associated with a primary display and/or a secondary display of the wagering game machine 460. After block 504, the flow continues at block 506.

At block 506, the wagering game machine 460 detects head movements and facial gestures of the player of the wagering game. For example, the video capture device 125 can capture video of the player's head movements and facial gestures. In one example, the video capture device 125 can capture video of the player moving his head to the left, right, up, down, etc., and also video of the player smiling, frowning, blinking, etc. After block 506, the flow continues at block 508.

At block 508, the wagering game machine 460 generates player input data based on the head movements and facial gestures of the player that were detected by the video capture device 125. In some implementations, the wagering game unit 462 of the wagering game machine 460 processes the video captured by the video capture device 125 and generates player input data based on the head movements and facial gestures. For example, the wagering game unit 462 generates player input data that represents the x, y, and z coordinates of the player's head at various instances in time. The wagering game unit 462 can also generate player input data that represents the x, y, and z coordinates of various data points of the player's facial features at various instance in time. In one example, the wagering game unit 462 may generate player input data for multiple data points in a player's eyes, nose, mouth, forehead, chin, etc. After block 508, the flow continues at block 510.

At block 510, the wagering game machine 460 modifies the content associated with the wagering game based on the player input data associated with the head movements and facial gestures of the player. In some implementations, the wagering game unit 462 can modify the wagering game content that is presented to the player based on the player input data. For example, the player input data associated with the head movements and facial gestures of the player can be used to maneuver a car, plane, boat, avatar, submarine, or other game content of a wagering game, e.g., a bonus game. After block 510, the flow continues at block 512.

At block 512, the wagering game machine 460 presents results associated with the wagering game on a display device of the wagering game machine 460. For example, the wagering game unit 462 generates the wagering game results, or obtains the results from the wagering game server 450, and the presentation unit 464 presents the results to the player via one of the displays of the wagering game machine 460. After block 512, the flow ends.

In some embodiments, a wagering game machine 460 may include a matrix of LEDs 235 and an LED light detector 225 to detect the head movements of a player of a wagering game, e.g., as shown in FIGS. 2A and 2B. The LED light detector 225 may first detect that a player's head is range of the wagering game machine 460. For example, the LED light detector 225 may detect that a player's head is within a predefined range of x,y coordinates from the wagering game machine 460. In one example, the predefined range of x,y coordinates may correspond to the range of x,y coordinates covered by the matrix of LEDs 235. In one example, a player's head may be detected by determining which of the LEDs 235 are blocked by the player's head and which LEDs 235 are not blocked by the player's head. In another example, the pattern of blocked and unblocked LEDs 235 may indicate whether a player's head is in range of the wagering game machine 460.

Furthermore, the LED light detector 225 can detect the head movements of the player of the wagering game. The LED light detector 225 may detect the player's head movements by determining which of the LEDs 235 are blocked by the player's head and which LEDs 235 are not blocked by the player's head at various instances in time. The wagering game unit 462 can generate player input data based on the player's head movements detected by the LED light detector 225. For example, the wagering game unit 462 can generate data, such as x,y coordinates, based on which LEDs 235 are and are not blocked by the player's head. The wagering game unit 462 then can modify the content of the wagering game based on the player input data associated with the player's head movements.

In other embodiments, the wagering game machine 460 may include a movable gaming chair 315, designed to rotate 360 degrees and tilt in all directions via a movable stem 318. The movable gaming chair 315 can detect a player's body movements and generate player input data based on the detected body movements. In one example, the chair 315 can generate data, such as x,z coordinates, corresponding to the player's body movements and provide this data to the wagering game unit 462. The wagering game unit 462 can then modify the content of the wagering game based on the player input data associated with the player's body movements.

FIG. 6 is a flow diagram ("flow") 600 illustrating operations for modifying content associated with multiplayer wagering games based on players' head and facial movements, according to some embodiments. The flow of 600 will be described with reference to the example wagering game machines of FIGS. 1A-3B and the example system architecture of FIG. 4. The flow diagram begins at block 602.

At block 602, the wagering game server 450 receives a notification message indicating that a player has been detected, via a video capture device 125, at each of a plurality of related wagering game machines 460. For example, a multiplayer game management unit 455 of the wagering game server 450 receives a notification message from each of the related wagering game machines 460. In one example, the multiplayer game management unit 455 may determine that a number of players N have been detected at N related wagering game machines 460 based on the received notification messages. In some implementations, the related wagering game machines 460 can be a bank of stationary wagering game machines 460 that offer players multiplayer wagering games, e.g. multiplayer bonus or side games, which can be controlled based on the players' head and facial movements. For example, while the players are each playing a unique instance of a primary wagering game, each of the related wagering game machines 460 can present the same multiplayer bonus game. In this example, all the players can contribute to modifying the game content based on the players' head and facial movements, as will be further described below. After block 602, the flow continues at block 604.

At block 604, the wagering game server 450 determines a plurality of multiplayer wagering games available for play based on the number of players detected at the related wagering game machines 460. For example, the wagering game server 450 may identify all the multiplayer wagering games that can be played by the number of players detected at the related wagering game machines 460. In some implementations, the wagering game server 450 may store information for each of the multiplayer wagering games indicating the number of players each game supports, e.g., up to four players. In one example, after detecting four players at the related wagering game machines 460, the wagering game server 450 can read the stored information about the multiplayer wagering games to determine which of the games can be played by four players. After block 604, the flow continues at block 606.

At block 606, the wagering game server 450 causes the related wagering game machines 460 to present a list (or other visual indication) of the multiplayer wagering games that are available to the players. For example, the multiplayer game management unit 455 generates and sends a message to each of the related wagering game machines 460 to cause the wagering game machines 460 to display the list of the available multiplayer wagering games. In another example, the multiplayer game management unit 455 causes the wagering game machines 460 to display game icons of the available multiplayer wagering games. The related wagering game machines 460 may receive a selection of one of the multiplayer wagering games from the players. The related wagering game machines 460 may then send a message to the wagering game server 450 indicating which one of the multiplayer wagering games was selected by the players. After block 606, the flow continues at block 608.

At block 608, the wagering game server 450 initiates the multiplayer wagering game selected by the players for presentation on the plurality of related wagering game machines 460. For example, the multiplayer game management unit 455 may receive a message indicating the multiplayer wagering game that was selected by the players. The multiplayer game management unit 455 may then initiate the selected multiplayer wagering game for presentation on the related wagering machines 460. It is noted, however, that in other embodiments the wagering game server 450 may automatically initiate one of the multiplayer wagering games without presenting a list of choices to the players. In other words, after detecting the number of players at the related wagering game machines 460, the wagering game server 450 may automatically initiate one of the available multiplayer wagering game that can be played by the detected number of players. After block 608, the flow continues at bock 610.

At block 610, the wagering game server 450 receives player input data, generated based on the head movements and facial gestures of the players, from the plurality of related wagering game machines 460. For example, the multiplayer game management unit 455 may receive player input data that represents the x, y, and z coordinates of the player's head and facial features at various instances in time, as was described above with reference to FIG. 5. After block 610, the flow continues at bock 612.

At block 612, the wagering game server 450 modifies the content associated with the multiplayer wagering game being presented on the related wagering game machines 460 based on the received player input data. In some implementations, the multiplayer game management unit 455 modifies the wagering game content based on how coordinated the head and facial movements are of the players playing the wagering game. In other words, the multiplayer game management unit 455 modifies the wagering game content based on the degree of coordination between the head and facial movements of the players. In one example, a multiplayer wagering game may involve multiple players controlling a single toboggan in a race against time. In the game, the players can cause the toboggan to turn left or right depending on whether all the players move their head left or right, respectively, in a coordinated fashion. In one example, the greater the degree of coordination between the player, the smoother or faster the toboggan moves or turns. It is noted, however, that in some example the wagering game server 450 may offer players the option to select a multiplayer game mode where random numbers, generated by the wagering game server 450, control the game content (e.g., determine how smooth or fast the toboggan moves or turns), rather than the degree of coordination between the players. In other implementations, the multiplayer game management unit 455 modifies different game content within the same wagering game for each of the players based on each player's head and/or facial movements. For example, for a four player wagering game, e.g., a poker game or a fighting game, the wagering game that is presented on all the wagering game machines 460 may display four avatars and each of the players may control one of the avatars based on the player's head and/or facial movements. After block 612, the flow continues at bock 614.

At block 614, the wagering game server 450 generates results associated with the multiplayer wagering game. For example, the content controller 451 can generate the wagering game results using a random number generator, and then provide the results to the related wagering game machines 460. After block 614, the flow ends.

It is noted, however, that in other embodiments, the related wagering game machines 460 may include an LED light detector 225 and LEDs 235 (as shown in FIG. 2A), or a movable gaming chair 315 (as shown in FIG. 3A). In these embodiments, the wagering game server 450 may modify the content associated with a multiplayer wagering game based on the players' head movements detected by a plurality of LED light detectors 225, or based on the players' body movements detected by a plurality of chairs 315.

FIG. 7 is a flow diagram ("flow") 700 illustrating operations for initiating and/or terminating wagering game sessions based on head tracking and/or facial recognition for a player of a wagering game, according to some embodiments. The flow of 700 will be described with reference to the example wagering game machines of FIGS. 1A-3B and the example system architecture of FIG. 4. The flow diagram begins at block 702.

At block 702, the wagering game machine 460 initiates a wagering game session in response to detecting a swipe of a player card in a card reader of the wagering game machine 460. In some implementations, the wagering game session is initiated after a player logs in by swiping the player card and account information (e.g., account number, player profile, etc.) associated with the player is obtained from the account server 410. In one example, the card reader can provide player identification information from the player card to the wagering game unit 462. The wagering game unit 462 may then communicate with the account server 410 to obtain the account information associated with the player. After the wagering game session is initiated, the player can begin to play one or more wagering games offered by the wagering game machine 460. After block 702, the flow continues at bock 704.

At block 704, an input device 461 detects that the player is in range of the wagering game machine 460. In some implementations, the video capture device 125 (e.g., a webcam) of the wagering game machine 460 detects that a player's head is in range of the wagering game machine 460, e.g., as described above with reference to FIGS. 1A-1B and FIG. 5. In some implementations, the video capture device 125 can be used to initiate the wagering game session instead of, or in addition, to the player card. In one example, after capturing video and/or images of the player via the video capture device 125, the wagering game unit 462 of the wagering game machine 460 can implement facial recognition techniques to identify the player. In one example, the wagering game unit 462 may access player profiles in the account server 410 to compare the facial recognition data derived from the video and/or images of the player to the player profiles to find a matching player profile. After block 704, the flow continues at bock 706.

At block 706, the wagering game machine 460 presents a wagering game on a display device of the wagering game machine 460. In one example, after receiving a player input (e.g., a bet), the wagering game unit 462 presents the wagering game on one of the displays of the wagering game machine 460. The wagering game machine 460 can present any type of wagering game, e.g., a wagering game that can be controlled via one or more buttons, joysticks, and/or touch screens of the wagering game machine 460, or a wagering game that can be controlled based on the player's head and/or facial movements. After block 706, the flow continues at bock 708.

At block 708, the wagering game machine 460 detects player input to control the wagering game content presented on the wagering game machine 460. For example, the wagering game unit 462 can detect button or touch screen presses, or the video capture device 125 and wagering game unit 462 can detect and process head and/or facial movements of the player, e.g., as was described above with reference to FIGS. 1A-1B and FIG. 5. After block 708, the flow continues at bock 710.

At block 710, the wagering game machine 460 presents results associated with the wagering game on a display device of the wagering game machine 460. For example, the wagering game unit 462 generates the wagering game results, or obtains the results from the wagering game server 450, and the presentation unit 464 presents the results to the player on one of the displays of the wagering game machine 460. After block 710, the flow continues at bock 712.

At block 712, the wagering game machine 460 terminates the wagering game session in response to detecting that the player is no longer in range of the wagering game machine 460. In one implementation, the video capture device 125 detects that the player is not in range of the wagering game machine 460, e.g., within a predefined range of x,y,z coordinates, as was described above with reference to FIG. 5. In one example, if the video capture device 125 does not detect the player in range for a predefined amount of time, the video capture device 125 may send a message to the wagering game unit 462 indicating that the player is no longer at the wagering game machine 460. In one example, the wagering game unit 462 may terminate the wagering game session immediately after receiving the message from the video capture device 125. In another example, the wagering game machine 462 may display text or other visual indication (e.g., a countdown of 20 seconds) on the wagering game machine indicating that the wagering game session is about to be terminated. When the wagering game session is terminated, the player's account is credited depending on the results of the wagering games the player played during the wagering game session, the player is logged off, and the wagering game machine 460 is made available for other players. After block 712, the flow ends.

It is noted, however, that in other embodiments, the wagering game sessions can be terminated, using the LED light detector 225 and LEDs 235 (as shown in FIG. 2A), by detecting that the player is no longer in range of the wagering game machine 460. In another example, to terminate the wagering game session, the chair of the wagering game machine 460 may include a weight sensor to detect when the player leaves the wagering game machine 460.

In some embodiments, casino operators may use facial recognition data (and/or other biometric data) generated at each of the wagering game machines 460 (e.g., as described above with reference to block 704 of FIG. 7) to improve the casino's security systems. For example, a casino security server of the wagering game system 400 can obtain the facial recognition data directly from the wagering game machines 460, or may obtain the identity of the detected players from the wagering game machines 460 (or the wagering game server 450) after they process the facial recognition data. The casino security server can use the video capture devices at the wagering game machines 460, in addition to the existing overhead (or eye in the sky) surveillance, to identify unwelcomed or potentially dangerous individuals, e.g., individuals that are on casino or law enforcement watch lists. In some embodiments, the wagering game server 450 may use facial recognition data (and/or other biometric data) for enhanced player validation, e.g., for game eligibility, or for improved electronic funds transfer (EFT) or advanced funds transfer (AFT) with financial institutions for transaction validation within casinos.

In other embodiments, a bank of wagering game machines can operate in conjunction with the wagering game server to detect and monitor the movements of a player as the player moves past each of the wagering game machines, and present content across the displays of the bank of wagering game machines based on the player's movements. In one implementation, when the player is playing a game in one of the wagering game machines, one or more of the sensory devices described above (e.g., the video capture device 125) can be used to detect the movements of the player, and a player card can be used to determine the identity of the player (e.g., by accessing the account server). The wagering game machine can detect when the player completes the wagering game session and begins to move away from the wagering game machine. As the player moves past each of the wagering game machines, the bank of wagering game machines can operate in conjunction with the wagering game server and the account server to present game content or other material that is of interest to the player (e.g., determined by accessing a player profile in the account server) across a plurality of the displays of the wagering game machines. For example, a game element customized for the player, such as a customized player fish used by the player in a fish game or a customized player race car used by the player in a car racing game, can "follow" the player across the displays of the wagering game machines as the player moves past each of the wagering game machines. In other words, each of the wagering game machines can detect when the player is within range of the wagering game machine and can display the customized game content when the player is within range. In some examples, the wagering game machine can detect the movements and motion of the player (e.g., using a video capture device) and can incorporate similar movements and motion to the customized game element that is displayed on the wagering game machines. In these examples, the bank of wagering game machines can implement short-range detection techniques when the player is within range of a wagering game machine, and longer-range, inter-machine detection techniques to track the movements of the player across multiple wagering game machines. In another implementation, rather than determining the identity of the player using the player card, the bank of wagering game machines can determine the identity of the player using facial (and/or other biometric) recognition techniques.

Additional Example Embodiments

According to some embodiments, the wagering game machine 460 may include the video capture device 125, and/or some of the other sensory devices described above, to detect a player's head movements and/or facial gestures to enhance the player's gaming experience. The following non-exhaustive list enumerates some additional example embodiments. Although the examples describe a wagering game machine 460 including the video capture device 125, it is noted that these examples may also incorporate other sensory devices (described above) in addition to or instead of the video capture device 125.

- The wagering game machine 460 including the video capture device 125 can detect potential players that stop and look at the wagering game machine 460. The wagering game machine 460 may encourage potential players to play the wagering game, e.g., by offering the potential players free spins (or other game incentives), taunting the potential players, presenting a preview of the wagering game, etc. If a potential player does not begin to play, the wagering game machine 460 can try different marketing and promotional materials to try to encourage game play.
- The wagering game machine 460 including the video capture device 125 can track a player's eyes to determine what the player is viewing on the screen. The wagering machine 460 can highlight or zoom the area of the screen the player is viewing. The player may select certain options on the screen that are highlighted or zoomed by blinking twice.
- The wagering game machine 460 including the video capture device 125 can track a player's head and/or facial movements for game selection. For example, the wagering game machine 460 may present a game carousel of a plurality of game options, and may rotate the carousel based on the direction the player moves his head.
- The wagering game machine 460 including the video capture device 125 can detect a crowd of people that has gathered around the wagering game machine 460. The wagering game machine 460 can improve the celebration or other audio/visual characteristics of the wagering game to encourage the people in the crowd to play the game, and/or may interact with the crowd to enhance the gaming experience. The wagering game machine 460 can inform the crowd of people (e.g., by posting a message on a secondary display) of the location of available wagering game machines that offer the same wagering game. For example, in a Star Trek game, a bank of four wagering game machines 460 may represent the "crew" of the Star Trek game. In this example, while one or more players are playing the Star Trek game, the wagering game machines 460 can detect one or more individuals watching the game, and can target these individuals to "join the crew" on one of the available machines 460.
- The wagering game machine 460 including the video capture device 125 can track a player's facial gestures and open a help menu if the player looks confused.
- The wagering game machine 460 including the video capture device 125 can offer a reel slots wagering game that displays 7 reels. The player selects which 5 out of the 7 reels to use for each spin by bumping two of the reels off the display using head and/or facial movements. In another example, the player selects which 3 out of 5 reels that are displayed to use for each spin. Furthermore, the wagering game 460 may allow the player to peek around the reel as it is spinning if the player moves his head up (or makes another head movement).
- The wagering game machine 460 including the video capture device 125 can offer a wagering game (e.g., a bonus game) where the game elements (e.g., pies, water balloons, etc.) seem to fly out of the screen towards the player. The player tries to dodge the game elements by moving his head. The wagering game machine 460 uses the video capture device 125 to track the head movements and determine when the player successfully (or unsuccessfully) dodges the game elements.
- The wagering game machine 460 including the video capture device 125 can offer a wagering game, e.g., a poker wagering game, where avatars represent each player on the screen. The wagering game machine 460 detects when a player looks at the avatar of another player. In response to the player looking at the avatar of another player, the wagering game machine 460 allows the players to interact (e.g., post a message, send a text, etc.) and/or place side bets on the game outcome. In one example poker wagering game, when the player looks at the avatar of another player, the video capture device 125 can detect the player's facial expressions or head movements and imitate the player's facial expressions or head movements with the avatar, e.g., to make a poker face, smile, shake the avatar's head, etc.
- The wagering game machine 460 may use the video capture device 125 to detect a player's (or an onlooker's) facial features for generating avatars for a wagering game. In one example, the wagering game machine 460 can generate avatars with mapped textures to resemble or imitate the player's facial features, either in a caricature or realistic fashion. In another example, the wagering game machine 460 may select other character images for the player's avatar, e.g., animals, cartoons, celebrities, etc.
- The wagering game machine 460 may the video capture device 125 to gather behavior statistics, e.g., where did the player look (i.e., eye focus), how did the player react to certain stimulus at various times (e.g., detect facial gestures, such as frowns, laughter, smiles, and confusion), among others. In one example, the wagering game machine 460 can use the behavior statistics to dynamically modify the content of the game. In another example, the behavior statistics can be gathered and used by the wagering game system 400 for marketing studies and analysis. In this example, when combined with a player tracking system, the behavior statistics can be studied in conjunction with gender, age, race, and/or other player characteristics and player profile information for market analysis purposes.

Additional Example Operating Environments

This section describes example operating environments, systems and networks, and presents structural aspects of some embodiments.

Wagering Game Machine Architecture

Figure 8:
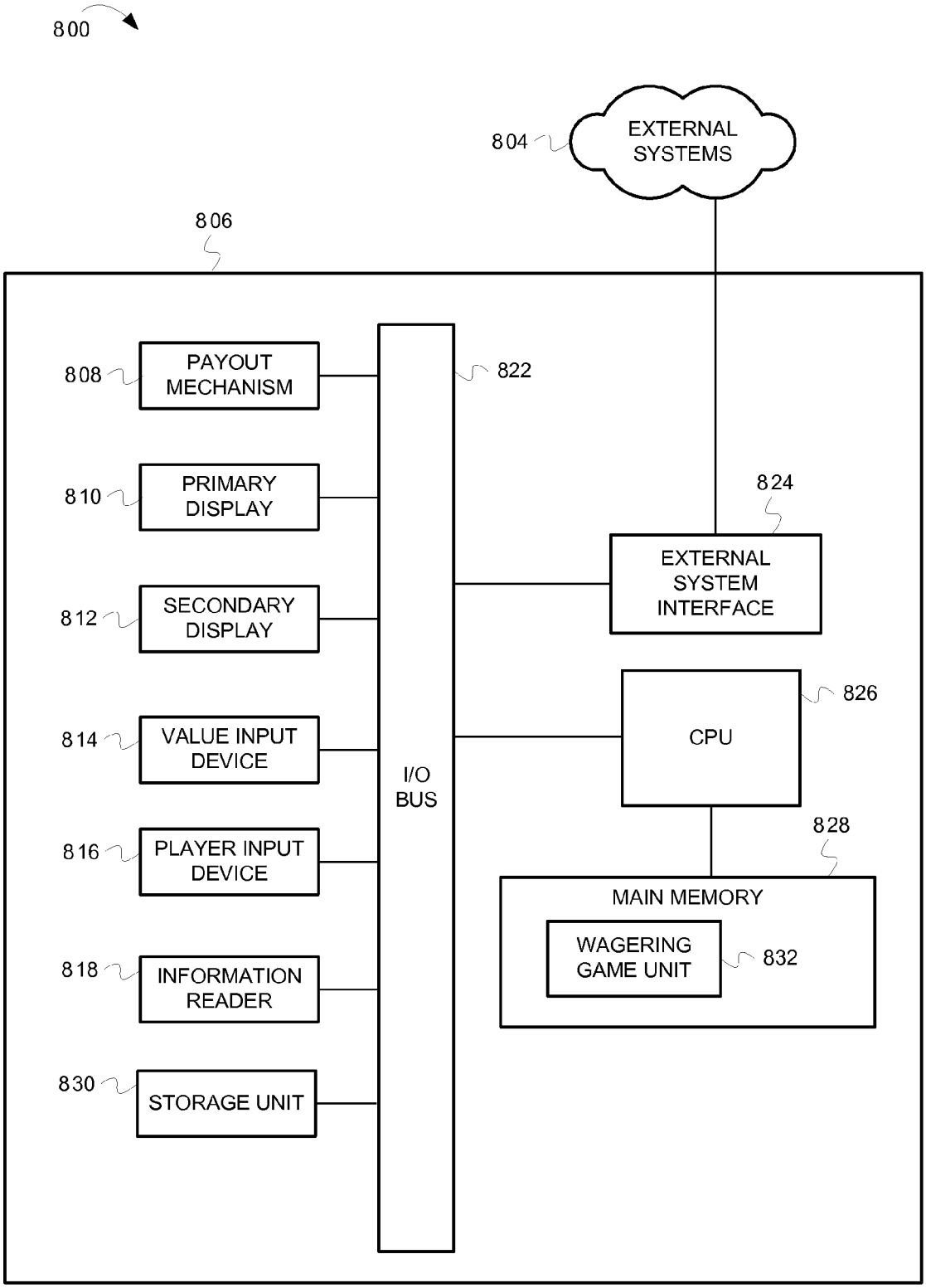
FIG. 8 is a conceptual diagram that illustrates an example of a wagering game machine architecture, according to some embodiments.

FIG. 8 is a conceptual diagram that illustrates an example of a wagering game machine architecture 800, according to some embodiments. In FIG. 8, the wagering game machine architecture 800 includes a wagering game machine 806, which includes a central processing unit (CPU) 826 connected to main memory 828. The CPU 826 can include any suitable processor, such as an Intel® Pentium processor, Intel® Core 2 Duo processor, AMD Opteron™ processor, or UltraSPARC processor. The main memory 828 includes a wagering game unit 832 and a game availability unit 836. In some embodiments, the wagering game unit 832 can present wagering games, such as video poker, video black jack, video slots, video lottery, reel slots, etc., in whole or part, and implement techniques for controlling wagering game content, e.g., as described above with reference to FIGS. 1A-7.

The CPU 826 is also connected to an input/output ("I/O") bus 822, which can include any suitable bus technologies, such as an AGTL+ frontside bus and a PCI backside bus. The I/O bus 822 is connected to a payout mechanism 808, primary display 810, secondary display 812, value input device 814, player input device 816, information reader 818, and storage unit 830. The player input device 816 can include the value input device 814 to the extent the player input device 816 is used to place wagers. The I/O bus 822 is also connected to an external system interface 824, which is connected to external systems (e.g., wagering game networks). The external system interface 824 can include logic for exchanging information over wired and wireless networks (e.g., 802.11g transceiver, Bluetooth transceiver, Ethernet transceiver, etc.)

In some embodiments, the wagering game machine 806 can include additional peripheral devices and/or more than one of each component shown in FIG. 8. For example, in some embodiments, the wagering game machine 806 can include multiple external system interfaces 824 and/or multiple CPUs 826. In some embodiments, any of the components can be integrated or subdivided.

In some embodiments, the wagering game machine 806 includes an online gaming module 837. The online gaming module 837 can process communications, commands, or other information, where the processing can control and present online wagering games.

Furthermore, any component of the wagering game machine 806 can include hardware, firmware, and/or machine-readable media including instructions for performing the operations described herein.

Example Wagering Game Machines

Figure 9:
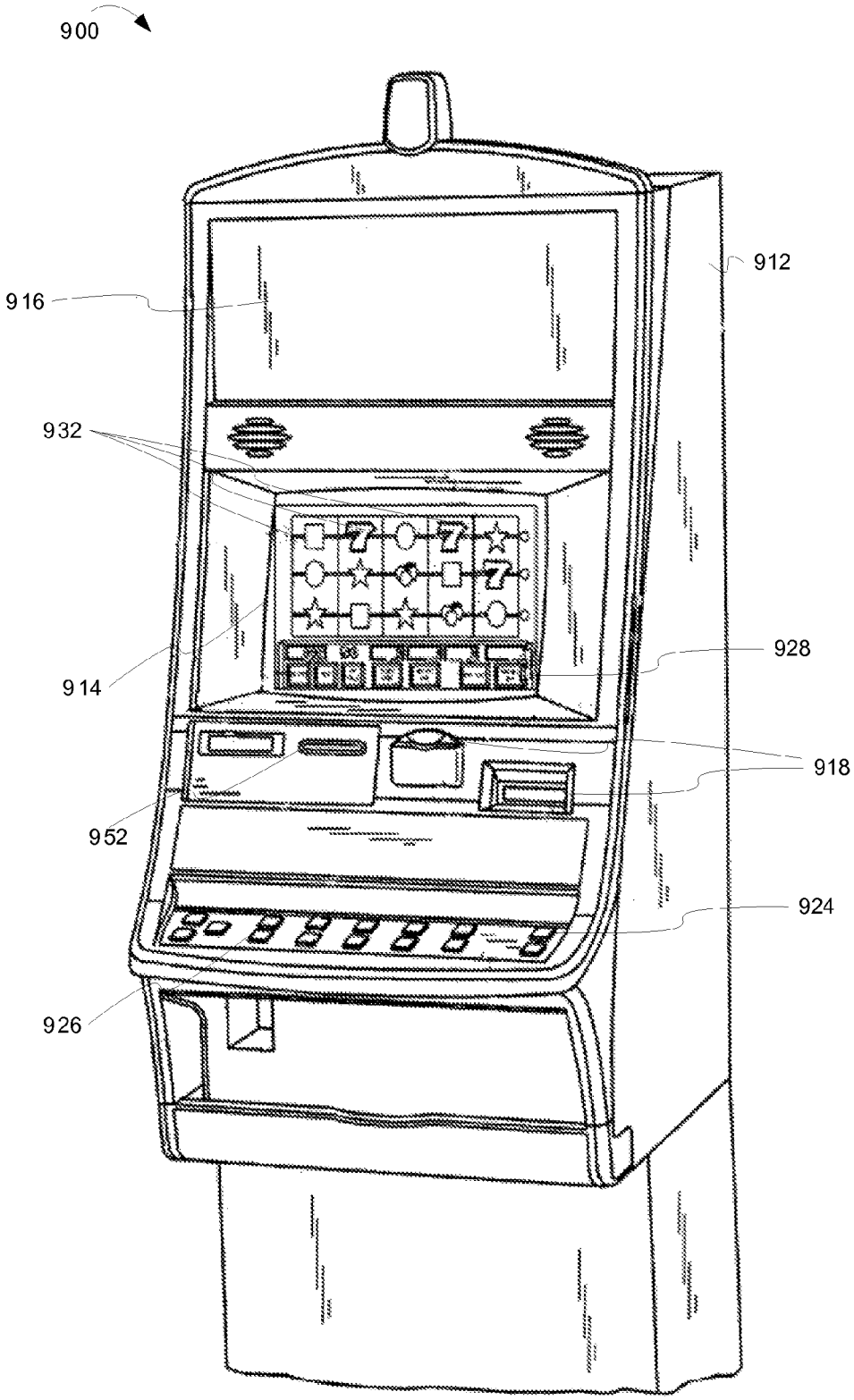
FIG. 9 is a perspective view of a wagering game machine, according to example embodiments.

FIG. 9 is a perspective view of a wagering game machine, according to example embodiments. Referring to FIG. 9, a wagering game machine 900 is used in gaming establishments, such as casinos. In some embodiments, the wagering game machine 900 can implement the functionality described above in FIGS. 1A-7 for controlling wagering game content.

According to embodiments, the wagering game machine 900 can be any type of wagering game machine and can have varying structures and methods of operation. For example, the wagering game machine 900 can be an electromechanical wagering game machine configured to play mechanical slots, or it can be an electronic wagering game machine configured to play video casino games, such as blackjack, slots, keno, poker, blackjack, roulette, etc.

The wagering game machine 900 comprises a housing 912 and includes input devices, including value input devices 918 and a player input device 924. For output, the wagering game machine 900 includes a primary display 914 for displaying information about a basic wagering game. In some implementations, the primary display 914 can also display information about a bonus wagering game and a progressive wagering game. The wagering game machine 900 also includes a secondary display 916 for displaying bonus wagering games, wagering game events, wagering game outcomes, and/or signage information. While some components of the wagering game machine 900 are described herein, numerous other elements can exist and can be used in any number or combination to create varying forms of the wagering game machine 900.

The value input devices 918 can take any suitable form and can be located on the front of the housing 912. The value input devices 918 can receive currency and/or credits inserted by a player. The value input devices 918 can include coin acceptors for receiving coin currency and bill acceptors for receiving paper currency. Furthermore, the value input devices 918 can include ticket readers or barcode scanners for reading information stored on vouchers, cards, or other tangible portable storage devices. The vouchers or cards can authorize access to central accounts, which can transfer money to the wagering game machine 900.

The player input device 924 comprises a plurality of push buttons on a button panel 926 for operating the wagering game machine 900. In addition, or alternatively, the player input device 924 can comprise a touch screen 928 mounted over the primary display 914 and/or secondary display 916.

The various components of the wagering game machine 900 can be connected directly to, or contained within, the housing 912. Alternatively, some of the wagering game machine's components can be located outside of the housing 912, while being communicatively coupled with the wagering game machine 900 using any suitable wired or wireless communication technology.

The operation of the basic wagering game can be displayed to the player on the primary display 914. The primary display 914 can also display a bonus game associated with the basic wagering game. The primary display 914 can include a cathode ray tube (CRT), a high resolution liquid crystal display (LCD), a plasma display, light emitting diodes (LEDs), or any other type of display suitable for use in the wagering game machine 900. Alternatively, the primary display 914 can include a number of mechanical reels to display the outcome. In FIG. 9, the wagering game machine 900 is an "upright" version in which the primary display 914 is oriented vertically relative to the player. Alternatively, the wagering game machine can be a "slant-top" version in which the primary display 914 is slanted at about a thirty-degree angle toward the player of the wagering game machine 900. In yet another embodiment, the wagering game machine 900 can exhibit any suitable form factor, such as a free standing model, bartop model, mobile handheld model, or workstation console model.

A player begins playing a basic wagering game by making a wager via the value input device 918. The player can initiate play by using the player input device's buttons or touch screen 928. The basic game can include arranging a plurality of symbols along a payline 932, which indicates one or more outcomes of the basic game. Such outcomes can be randomly selected in response to player input. At least one of the outcomes, which can include any variation or combination of symbols, can trigger a bonus game.

In some embodiments, the wagering game machine 900 can also include an information reader 952, which can include a card reader, ticket reader, bar code scanner, RFID transceiver, or computer readable storage medium interface. In some embodiments, the information reader 952 can be used to award complimentary services, restore game assets, track player habits, etc.

GENERAL

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the inventive subject matter, which are defined only by the appended claims. Each of the embodiments described herein are contemplated as falling within the inventive subject matter, which is set forth in the following claims.

The invention claimed is:

1. A method comprising:

presenting a wagering game on a display device of a wagering game machine;

detecting head movements and facial gestures of a player of the wagering game via a video capture device of the wagering game machine;

determining player input data based on the head movements and facial gestures of the player;

controlling wagering game activity associated with wagering game content of the wagering game based on the player input data that is indicative of the head movements and facial gestures of the player, wherein the controlling wagering game activity includes controlling a direction of movement associated with at least one element of the wagering game based on the head movements and facial gestures of the player; and presenting results of the wagering game on the display device of the wagering game machine.

2. The method of claim 1, further comprising detecting that the player is positioned within a predefined range from the video capture device of the wagering game machine.

3. The method of claim 1, wherein said detecting head movements and facial gestures of the player comprises capturing video of the head movements and facial gestures of the player via the video capture device.

4. The method of claim 3, wherein said determining player input data comprises, based on the video of the player's head movements and facial gestures, determining Cartesian coordinate data for a plurality of data points associated with the player's head and facial features at various instances in time.

5. The method of claim 1, wherein said controlling wagering game activity associated with the wagering game content comprises modifying an orientation of the wagering game content being presented on the display device of the wagering game machine based on the player input data that is indicative of the head movements and facial gestures.

6. The method of claim 1, further comprising:

initiating a wagering game session at the wagering game machine in response to detecting a swipe of a player card in a card reader of the wagering game machine;

detecting, via the video capture device, that the player is positioned within a predefined range of the video capture device of the wagering game machine prior to presenting the wagering game on the display device of the wagering game machine; and terminating the wagering game session in response to detecting, via the video capture device, that the player is no longer positioned within the predefined range of the video capture device of the wagering game machine.

7. The method of claim 1, further comprising:

detecting a position of the player relative to the wagering game machine via the video capture device; and adjusting at least one of a height of a gaming chair of the wagering game machine and a position of a display of the wagering game machine based on the position of the player.

8. The method of claim 1, wherein the video capture device is a video camera.

9. A wagering game machine comprising:

a gaming chair comprising a plurality of light emitting diodes (LEDs); and a wagering game terminal coupled to the gaming chair, the wagering game terminal comprising:

a presentation unit configured to present a wagering game on a display device of the wagering game terminal;

an LED light detector configured to detect movements of a player of the wagering game based on which of the plurality of LEDs are blocked by the player and which of the plurality of LEDs are not blocked by the player; and a wagering game unit configured to:

determine player input data based on the movements of the player detected by the LED light detector; and modify content of the wagering game based on the player input data that is indicative of the movements of the player.

10. The wagering game machine of claim 9, wherein the plurality of LEDs are positioned on a headrest of the gaming chair.

11. The wagering game machine of claim 9, wherein the wagering game unit configured is further configured to control a direction of movement associated with one or more game elements of the wagering game based on the player input data that is indicative of the movements of the player.

12. The wagering game machine of claim 9, wherein the wagering game unit is configured to generate player input data indicating which of the plurality of LEDs are blocked by the player and which of the plurality of LEDs are not blocked by the player.

13. The wagering game machine of claim 9, wherein the wagering game unit is further configured to modify an orientation of the wagering game content being presented on the display device of the wagering game terminal based on the player input data that is indicative of the player's head movements.

14. The wagering game machine of claim 9, wherein the gaming chair further comprising a plurality of weight sensors configured to detect leaning movements of the player to modify content of the wagering game.

15. A method comprising:

determining a plurality of multiplayer wagering games that are available for play at a plurality of wagering game machines based on a number of players detected at the wagering game machines;

causing each of the wagering game machines to present a visual indication of the multiplayer wagering games that are available for play;

initiating, based on player selection, one of the multiplayer wagering games for presentation on each of the wagering game machines;

receiving player input data from the plurality of wagering game machines, wherein the player input data is generated based on head movements and facial gestures of each of the players detected at each of the wagering game machines via a video capture device;

modifying content of the multiplayer wagering game being presented on the plurality of wagering game machines based on the player input data associated with the head movements and facial gestures of the players; and generating results associated with the multiplayer wagering game.

16. The method of claim 15, further comprising receiving an indication, from each of the wagering game machines, when each of the players is in range of the video capture device.

17. The method of claim 15, wherein said causing each of the wagering game machines to present a visual indication of the multiplayer wagering games that are available for play comprises sending a message to each of the wagering game machines indicating the multiplayer wagering games that are available for play to cause the wagering game machines to present a visual indication of the multiplayer wagering games that are available for play.

18. The method of claim 15, further comprising:

detecting when a player completes a wagering game session on a wagering game machine of the plurality of wagering game machines;

detecting when the player moves away from the wagering game machine and moves past one or more of the plurality of wagering game machines; and presenting customized game content to the player as the player moves past the one or more of the plurality of wagering game machines.

19. One or more non-transitory machine-readable storage media, having instructions stored therein, which, when executed by one or more processors causes the one or more processors to perform operations that comprise:

presenting a wagering game on a display device of a wagering game machine;

detecting body movements of a player of the wagering game via a movable gaming chair of the wagering game machine;

determining player input data based on the body movements of the player;

modifying wagering game content based on the player input data that is indicative of the player's body movements in the movable gaming chair; and presenting results of the wagering game on the display device of the wagering game machine.

20. The one or more non-transitory machine-readable storage media of claim 19, wherein the operations further comprise detecting whether the player is seated on the movable gaming chair of the wagering game machine via a weight sensor.

21. The one or more non-transitory machine-readable storage media of claim 19, wherein said operation of determining player input data based on the player's body movements comprises determining Cartesian coordinate data for the player's body movements at various instances in time.

22. The one or more non-transitory machine-readable storage media of claim 19, wherein said operation of modifying wagering game content based on the player input data that is indicative of the player's body movements in the movable gaming chair comprises modifying an orientation of wagering game content being presented on the display device of the wagering game machine based on the player input data associated with the player's body movements.

* * * * *